US006070848A

United States Patent [19]

Ogren

[11] Patent Number: 6,070,848

[45] Date of Patent: Jun. 6, 2000

[54] DECORATIVE TREE STAND

[75] Inventor: John D. Ogren, Coon Rapids, Minn.

[73] Assignee: R.D.S. Associates, Inc., St. Bonifacius, Minn.

[21] Appl. No.: 09/193,929

[22] Filed: Nov. 17, 1998

[51] Int. Cl.[7] ..... F16M 13/00; F16M 11/24

[52] U.S. Cl. ..... 248/523; 248/188.4

[58] Field of Search ..... 248/523, 188.4, 248/650; 47/40.5, 42

[56] References Cited

U.S. PATENT DOCUMENTS

| | | | |
|---|---|---|---|
| 3,784,136 | 1/1974 | Lopez | 47/40.5 |
| 4,126,963 | 11/1978 | Dunbar | 47/40.5 |
| 4,261,138 | 4/1981 | St. Georage Syms | 47/40.5 |
| 4,520,981 | 6/1985 | Harrigan | 248/413 |
| 4,585,201 | 4/1986 | Pursell | 248/523 |
| 4,610,356 | 9/1986 | Porter et al. | 206/423 |
| 5,478,042 | 12/1995 | Bliss et al. | 248/523 |
| 5,551,659 | 9/1996 | Sofy | 248/523 |
| 5,797,580 | 8/1998 | Ryberg | 248/523 |

*Primary Examiner*—Ramon O. Ramirez
*Assistant Examiner*—David Heisey
*Attorney, Agent, or Firm*—Haugen Law Firm PLLP

[57] ABSTRACT

A tree stand for holding decorative trees such as Christmas trees in an erect and upright disposition, including those tree having less-than-straight trunks, while providing a water-retaining reservoir with water in contact with the tree to provide a water source for the tree. The stand provides for the tree to be securely fastened to the trunk through a lag screw in a bore within the trunk, and further provides an adjustable leveling system for maintaining the tree in a stable upright disposition.

4 Claims, 6 Drawing Sheets

DECORATIVE TREE STAND

BACKGROUND OF THE INVENTION

The present invention relates generally to an improved tree stand, and more particularly to an improved tree stand for holding decorative trees such as Christmas trees in an erect and upright disposition, while at the same time providing a reservoir wherein the tank maintains the water supply in contact with the tree to provide a continuing source for the needs of the tree. Additionally, the configuration and other features of the stand of the present invention provide a means for securing the tree in a stable position, with this stability and erect disposition being facilitated by ease of fixing the tree to the stand. These features will be described more fully hereinbelow.

In the past, various apparatus have been devised, designed, and utilized wherein a tree stand receives the butt end of a decorative tree, maintains the tree in upright disposition, and also provides a means for providing a supply of water and/or other nutrients to the tree. However, these devices have frequently suffered from the lack of a suitable means for accurately leveling the stand, and hence the tree being retained therein, or alternatively suffer from a lack of an ability to receive and retain an adequate supply of water. In other words, the decorative tree, when erected, may be unstable and hence unable to withstand the anticipated and frequently experienced contact between a decorative tree such as a Christmas tree and young children and/or infants. As a result, if a stand does not provide adequate stability, the tree and its stand are tipped onto the floor, and as a result, any ornamentation may be bent, broken or destroyed, and additionally, the water supply is spilled onto the surface of the floor and/or carpet. As a result, there exists the need for a stable, durable stand, which is capable of receiving and holding a tree in erect disposition, and at the same time provides for appropriate leveling in order to accommodate for unevenness in supporting floors, or alternatively an uneven and/or less-than-straight tree trunk.

SUMMARY OF THE INVENTION

The present invention distinguishes itself over prior art devices in that the stand is stable, durable, and holds and/or retains the tree securely in a definite upright disposition. The stand structure includes a water retaining vessel such as a tank which has a relatively broad diameter, and hence is reasonably accessible, and at the same time, provides a means for properly leveling the tree being held within the stand. As a result, the tree is held rigidly, erectly, and at the same time, capable of being provided with an adequate supply of water for retention of its needles and/or foliage with a sufficient moisture supply, and at the same time permit water to be conveniently added at intervals indicated.

The tree stand of the present invention includes a means for adjustably positioning and retaining the butt end of a tree trunk in vertical disposition, with the stand further including a reservoir in the form of a tank capable of conveniently receiving and retaining an appropriate supply of water for delivery to the trunk. The reservoir means includes a generally cylindrical water impervious tank with a closed bottom and a generally cylindrical upstanding side wall or walls forming an open top. The closed bottom of the reservoir means is provided with a means for coupling and/or adjustably receiving a tree mounting stabilizer base plate thereon, with the base plate including equally arcuately spaced radially disposed adjustably positionable leveling pads on the underside of the closed bottom for appropriately leveling the tree in appropriate erect disposition. The tree mounting stabilizer base plate is secured and/or engaged with the tank bottom, with the plate including lag screw means which is operatively coupled to the base plate and which projects upwardly for engagement with and attachment to the butt end of a decorative tree. The stabilizer base plate further includes a plurality of radially extending stabilizing levelers which extend outwardly from the lag screw, and which are configured so that they diverge radially upwardly from the lag screw, and thus make contact with the tree at or adjacent its outer circumference. In this fashion, the stabilizing levelers enhance the stability of the tree being retained and held by the lag screw. The stabilizing levelers, as indicated, taper inwardly so as to ensure that the butt end of the tree is engaged and makes contact with the levelers at or adjacent the outer circumference of the tree. In order to provide additional effectiveness for the stabilizing levelers, the tapered upper surface are formed as flanged plates, thus increasing the contact area between the tree and the levelers.

Therefore it is a primary object of the present invention to provide an improved tree stand for decorative trees such as Christmas trees and/or the like, which is stable and durable, and provides means for releasably retaining decorative trees in upright disposition therein, and furthermore includes a reservoir and/or tank for providing an adequate supply of water to meet the needs of the tree, and wherein the water tank is conveniently accessible and/or available for filling.

It is a further object of the present invention to provide an improved tree stand for decorative trees such as Christmas trees or the like which includes a mounting means comprising a lag screw to be received within a bore formed in the butt end of the tree, and wherein the stand is durable, stable, and provides for ongoing availability of water to the retained tree.

It is yet a further object of the present invention to provide an improved tree stand for decorative trees such as Christmas trees or the like which includes a reservoir means incorporating a tank or other form of water receptacle, to retain and make available an ongoing adequate supply of water for trees held therewithin, wherein stabilizing levelers are provided which are configured to contact the outer periphery and/or circumferential portion of the butt end of a tree mounted within the stand.

It is yet a further object of the present invention to provide an improved tree stand for decorative trees such as Christmas trees or the like which includes a means in the form of a lag screw arranged to be received within a bore formed along the axis from the butt end of a tree trunk, and wherein stabilizing levelers are provided to engage the outer end surfaces of the butt end of the trunk in order to rigidly and reliably retain the tree therewithin, and wherein the reservoir means is further provided with adjustable leveling feet or pads to ensure that the tree remains in stable upright disposition.

Other and further objects of the present invention will become apparent to those skilled in the art upon a study of the following specification, appended claims, and accompanying drawings.

IN THE DRAWINGS

FIG. 1 a perspective view of the tree stand of the present invention retaining a decorative tree, such as a conifer, and with the tree being held and retained in upright disposition;

Figure 13:
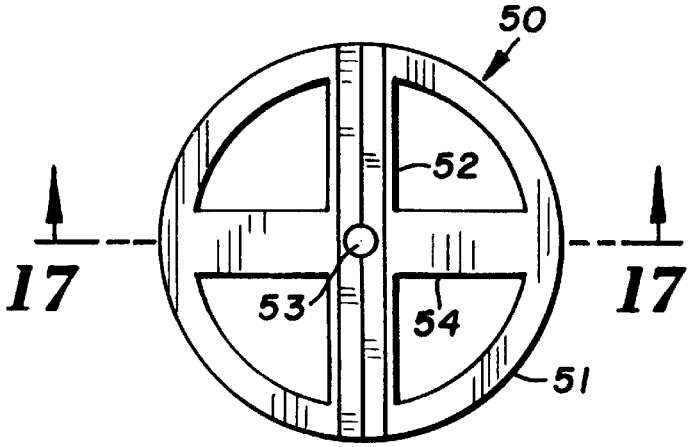
Figure 14:
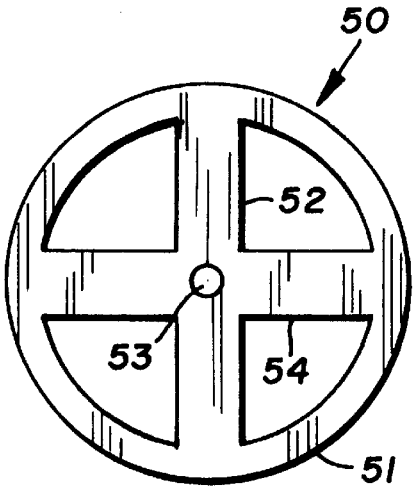
Figure 15:
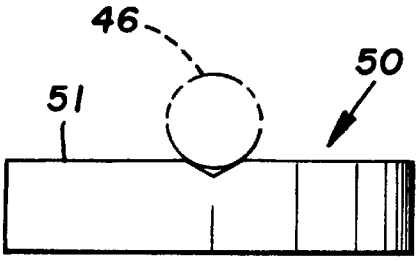
Figure 16:
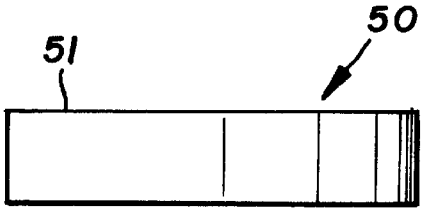
Figure 17:
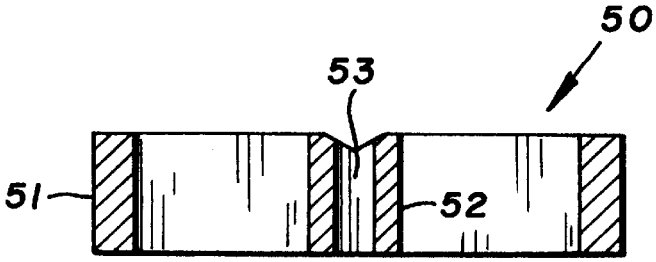
Figure 18:
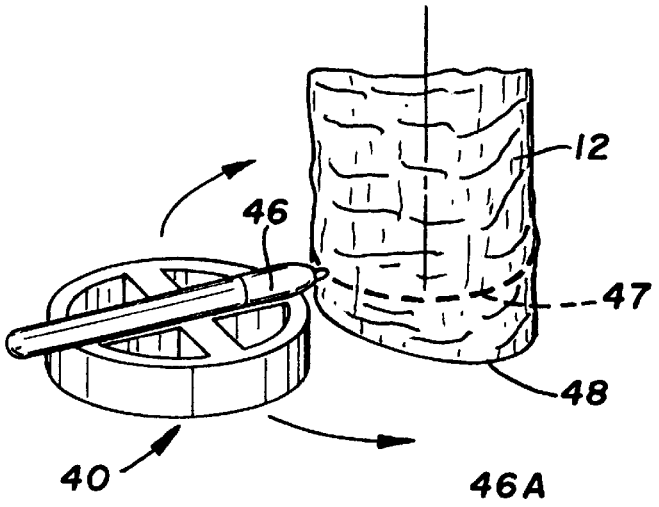
Figure 19:
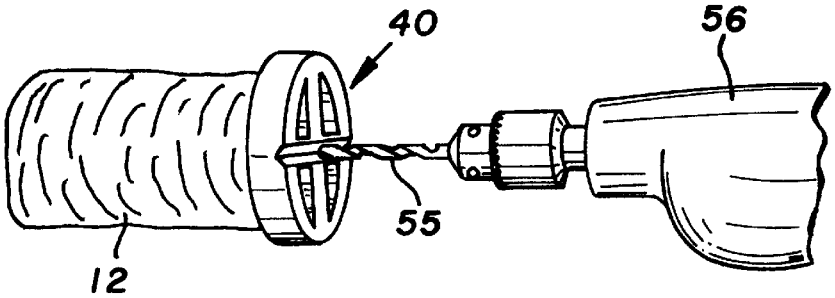
Figure 20:
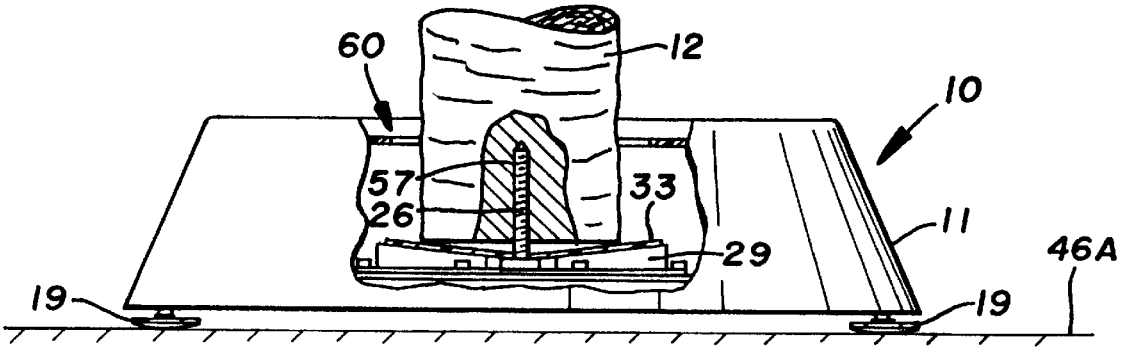

FIGS. 13, 14, 15, and 16 are top view, bottom view, front view, and side view respectively of an alternative form of drilling guide means for ensuring the creation of a transverse cut along the butt end of a tree trunk;

FIG. 17 is a vertical sectional view taken along the line and in the direction of the arrows 17—17 of FIG. 13;

FIGS. 18 and 19 are perspective views illustrating two steps in the utilization of the drilling guide device of FIGS. 13–17, with FIG. 18 illustrating the trunk marking step and with FIG. 19 illustrating the bore formation or drilling step; and FIG. 20 is a side elevational view, partially broken away, illustrating the detail of the lag screw being positioned in the drilled hole or bore in order to firmly affix the tree trunk to the stand of the present invention.

DESCRIPTION OF THE PREFERRED EMBODIMENT

In accordance with the preferred modification of the present invention, and with particular attention being directed to FIGS. 1–4 of the drawings, the decorative tree stand generally designated 10 includes means for adjustably positioning and retaining the butt end of a tree trunk within and in combination with reservoir means 11, with the reservoir means being designed to receive a supply of water for delivery to the butt end of a tree such as butt end 12 of tree generally designated 13. Tree 13 is in the form of a conventional decorative tree such as a Christmas tree, of the conifer type.

Figure 5:
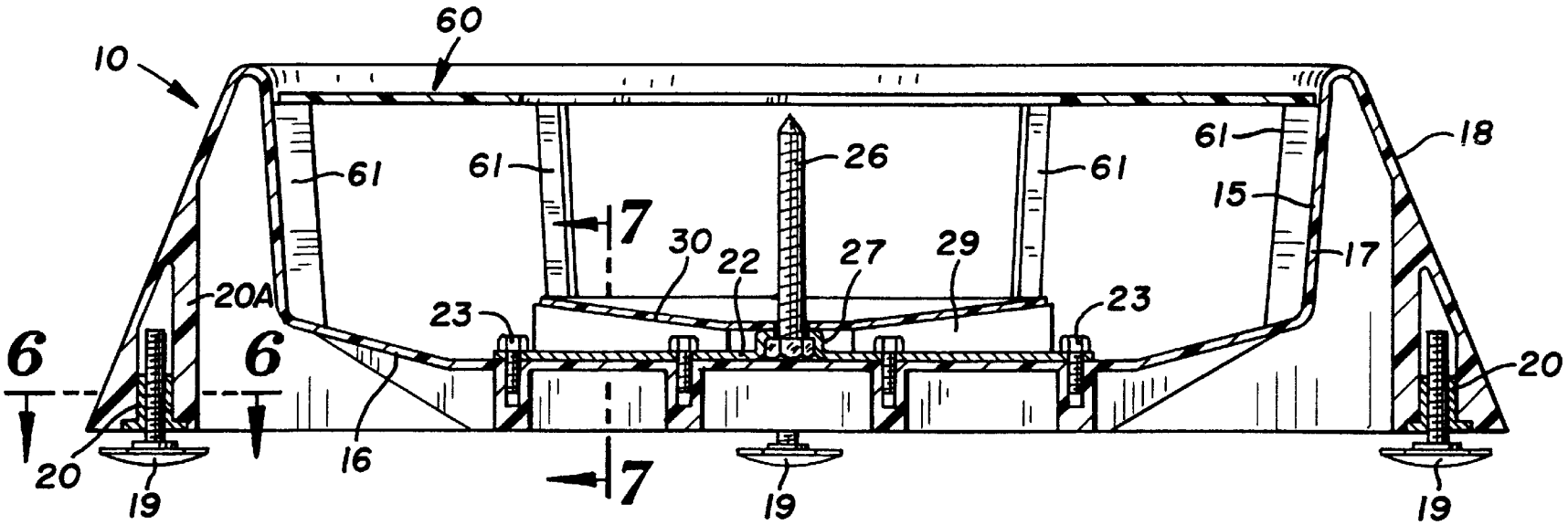
FIG. 5 is a vertical sectional view taken along the line and in the direction of the arrows 5—5 of FIG. 2, and illustrating the configuration of the reservoir means including the tank along with the other features of the invention.
Figure 7:
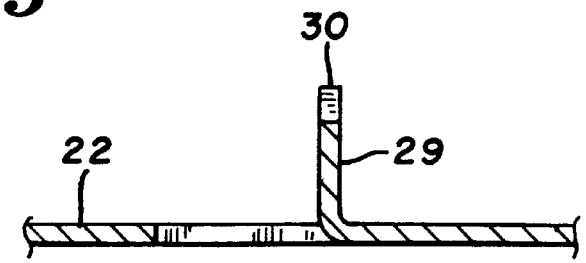
FIG. 7 is a detail vertical sectional view taken along the line and in the direction of the arrows 7—7 of FIG. 5.
Figure 6:
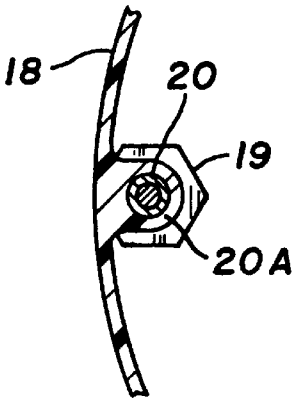
FIG. 6 is a detail fragmentary horizontal sectional view taken along the line and in the direction of the arrows 6—6 FIG. 5.
Figure 8:
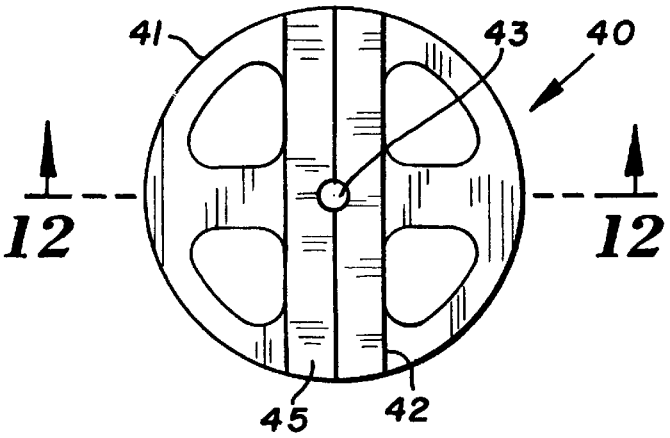
FIG. 8 is a top view of a drilling guide device useful in marking the butt end of a trunk of a decorative tree for the purpose of cutting the trunk transversely of the axis.
Figure 9:
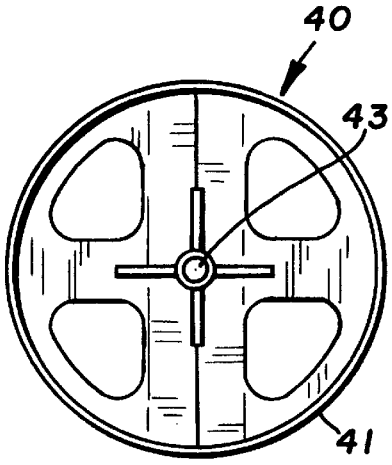
FIG. 9 is a bottom view of the device shown in FIG. 8.
Figure 10:
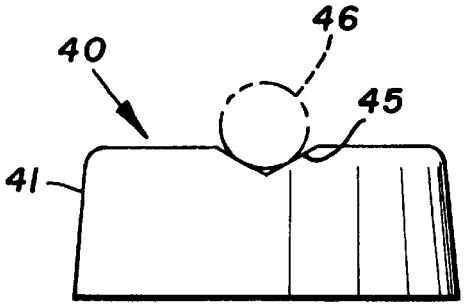
FIGS. 10 and 11 are front view and side views respectively of the drilling guide device of FIG. 8.
Figure 11:
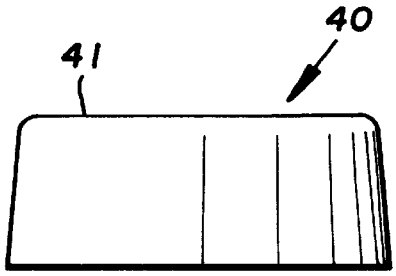
Figure 12:
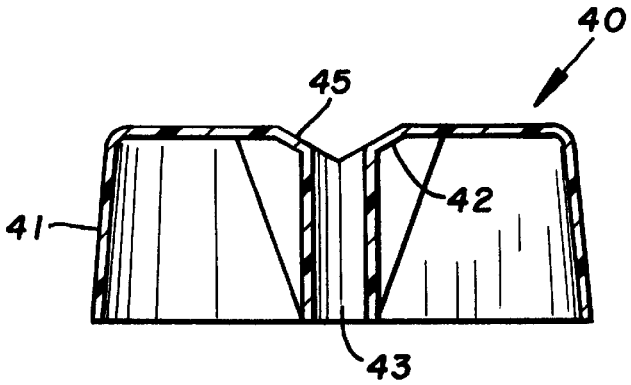
FIG. 12 is a vertical sectional view taken along the line and in the direction of the arrows 12—12 of FIG. 8.

With added addition being directed to FIG. 5 of the drawings, reservoir 11 comprises a generally cylindrical water retaining tank 15 with a closed bottom 16 and a generally upstanding side wall as at 17. Reservoir means includes an inverted lip as at 18 for receiving adjustably positionable leveling feet or pads 19—19 within threaded bores 20—20 positioned in a foot support boss as at 20A. Four such foot support boss elements are preferably provided, being disposed at 90° arcuately spaced relationship adjacent the outer perimeter of stand 10. As illustrated in FIG. 5, these leveling pads 19—19 and support bosses 20A—20A are located along the outer perimeter of inverted lip 18 forming an outer or external shroud for stand assembly 10.

Tank 15 has an open top, as indicated, and the closed bottom is provided with means for attachably receiving a tree mounting stabilizer base plate 22 therewithin. The means for attachment of plate 22 include self-tapping screws as at 23—23 received in bosses where shown in FIG. 5. Screws 23—23 are arranged to be received in arcuately spaced disposition preferably adjacent to and extending between the inner and outer circumferences of plate 22.

In order to add greater stability and greater versatility in achieving an upright and appropriately appearing disposition for the tree mounted within the stand, leveling pads 19—19 are provided, with the system providing ultimate and final fine-tuning of the tree in order to provide the tree in upright position within the stand.

The tree mounting stabilizer base plate 22 further includes lag screw means 26 secured such as by welding or capture at the head and as at 27. Lag screw 26 is then designed to be fast upon plate 22, and rotate therewith. Lag screw 26 projects upwardly in order to engage a bore to be formed in the butt end of the trunk 12 of tree 13.

Stabilizer base plate 22 further includes a plurality of arcuately spaced radially extending stabilizing levelers 29—29. Levelers 29—29 are preferably stamped out of or injection molded into, or otherwise secured to the stabilizer base plate 22 such as by spot-welding or alternatively by rivets, and are positioned radially outwardly from lag screw 26 and extending upwardly from the stabilizer base plate 22. Additionally, stabilizing levelers 29—29 are tapered inwardly to provide an outer exposed or upper surface 30 to engage the butt end of the tree adjacent its outer circumference. While the embodiment illustrated herein is provided with six such stabilizing levelers, it will be appreciated that other numbers may be satisfactorily utilized, including numbers of three or more. The stabilizing levelers contribute sufficient rigidity and durability to the overall tree arrangement.

Buffer plate 33, as shown in FIG. 20, is provided in order to prevent or reduce the tendency of the exposed ends of the individual stabilizing ribs 34—34 from separating, splitting, or otherwise radially breaking the continuity of the base of the trunk. As a material of construction for the buffer plate 33, 0.040 inch polyethylene has been found suitable. For purposes of clarity, buffer plate 33 is shown in a depressed or concave disposition as if it were being forced downwardly by the butt end of a tree trunk.

Figure 1:
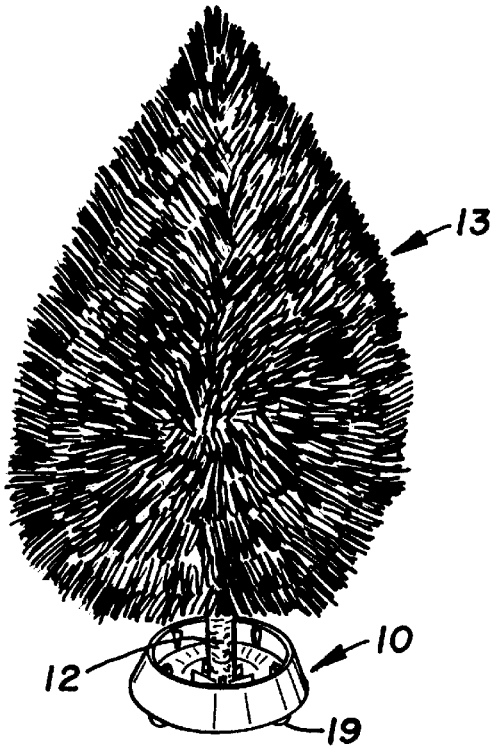
Figure 2:
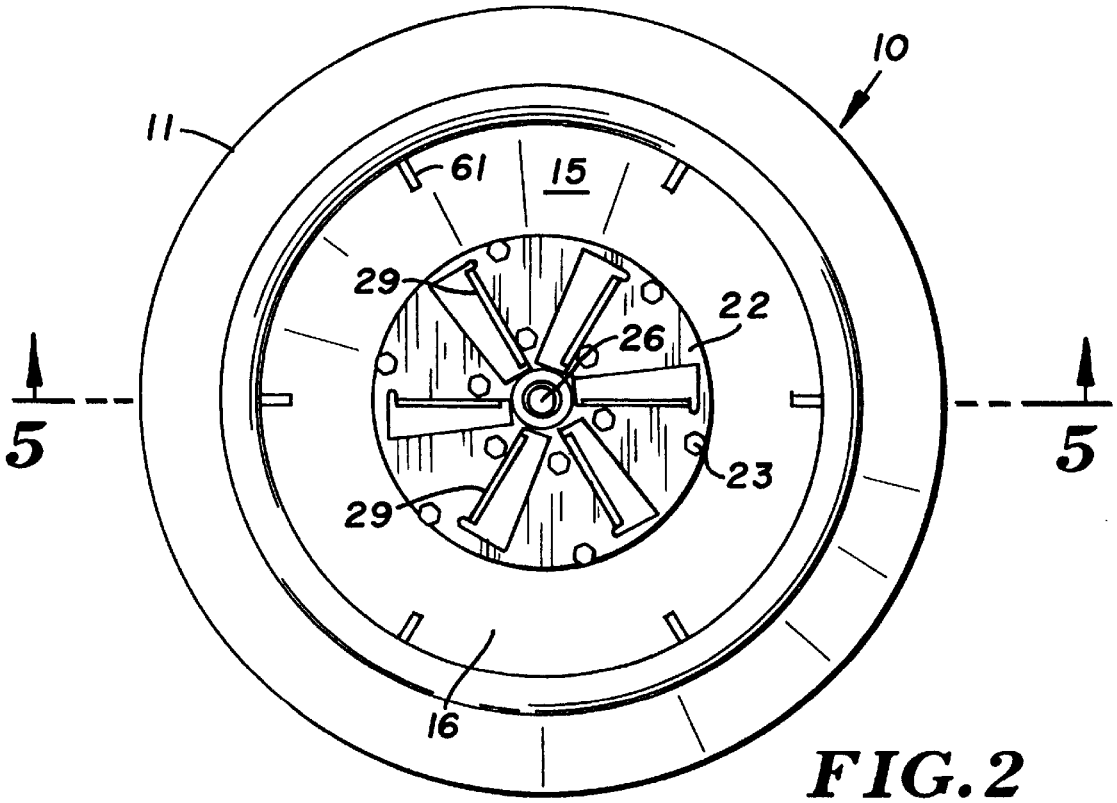
FIG. 2 is a top plan view of the tree stand shown in FIG. 1.
Figure 3:
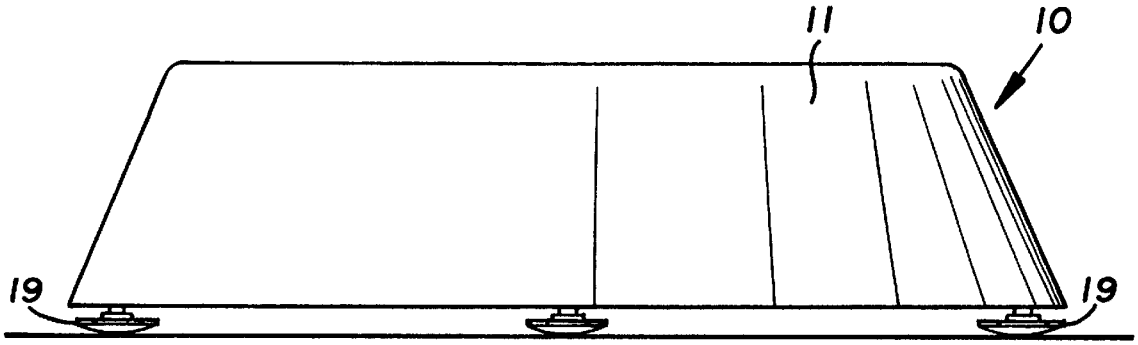
FIG. 3 is a side elevational view of the device illustrated in FIGS. 1 and 2.
Figure 4:
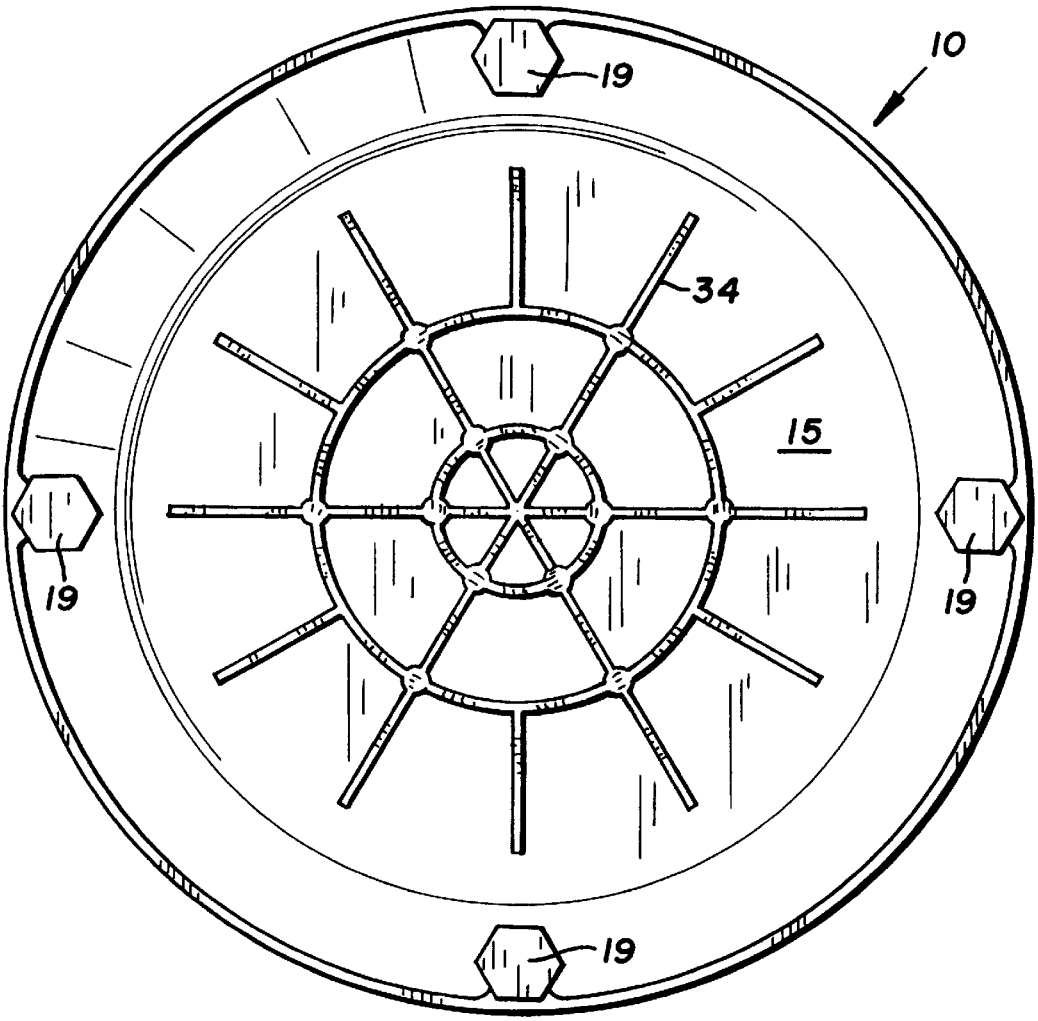
FIG. 4 is a bottom plan view of the stand illustrated in FIGS. 1–3.

In order to further enhance the rigidity of the overall structure, tank 15 is provided with stabilizing ribs such as shown at 34—34 in FIG. 4. Stiffening ribs 34—34 are preferably arranged in a suitable grid pattern along the undersurface of tank 15, and as such, provide and enhance the rigidity of the overall structure. An orthogonal pattern may also be employed. In addition, stiffening ribs 34—34, when orthogonally arranged, provide an appropriate and desirable boss or anchor point for self-tapping screws 23—23 utilized to secure base plate 22 to the bottom of tank 15. Such ribs are particularly useful in structures formed of molded plastic, although stiffener ribs may be suitably employed in connection with articles of this type fabricated from molded plastic. If formed of molded plastic, suitable engineered plastics formed of high density polyethylene or other reinforced polyesters and/or polyamides may be suitably employed.

As is indicated in FIGS. 8–12, a drilling guide device is provided in order to ensure that the butt end of the tree trunk is scribed and cut along a plane transverse to the axis of the trunk. In this connection, guide generally designated 40 includes a cylindrical body member 41 with a cross-member 42 having a bore 43 formed coaxially with the center of body 41. Additionally, pen resting groove 45 is provided in cross-member 42 in order to permit receipt of a marker such as scribe or marking pen 46 illustrated in phantom in FIG. 10. In order to utilize the device of FIGS. 8–12, and with attention now being directed to FIGS. 18 and 19, guide 40 is placed on a flat surface such as a floor as at 46A, and with tree trunk 12 being supported in vertical disposition on floor 46A, guide 40 is moved about the outer circumference of tree trunk 12 with marking pen 46 being utilized to form a cutting line as illustrated in broken-line 47 about trunk 12. In this event, the original trunk cut providing the slanted or canted surface 48, is not satisfactory for appropriately mounting tree 12 within stand 10.

With attention being directed to the embodiments of FIGS. 13–17, an alternative design of guide member is illustrated, with guide member 50 including a body 51 together with cross-members 52 and 54 extending across at the diameter of the body 51 at a right angular relationship. Bore 53 is provided in order to function as a drill guide similar to the bore 43 of the embodiment of FIGS. 8–12.

In order to appropriately bore the butt end of the tree along its axis, drilling guide hole such as hole 43 and/or 53 is utilized to receive a drill bit such as bit 55 in FIG. 19. Drill 56 drives bit 55 rotatably through guide 40, and while in that disposition, bore 57 is formed in and along butt end of trunk 12. For most purposes, and depending upon the nature of the species of tree, a drill bit is utilized having a diameter significantly less than that of the lag screw, with a ⅜th inch lag screw being best appropriately accommodated within a 3/16th inch bore. Of course, a harder natural wood will require a bore which is somewhat more closely matched, but yet undersized, to that of the outer diameter of lag screw 26. Those skilled in the art will have knowledge of the appropriate bit size to be employed in connection with any of the common species of conifers used for decorative purposes, particularly as Christmas trees.

As is indicated in the configurations illustrated herein, the stabilizing levelers which are employed in the system make contact with the outer circumferential portions of trunk 12 of tree 13. By making contact with this outer circumferential area, the overall stability of the tree within the stand is considerably and desirably enhanced.

In the overall operation, a suitable decorative tree such as Christmas tree 13 will be selected, and typically brought to one's residence before being set up. In order to prepare the tree for mounting within stand 10, a drilling guide such as 40 is provided with a marking pen, and with the tree held in upright position while resting on a flat surface such as floor 46A, line 47 is scribed around the surface of trunk 12, with the line 47 forming a new cutting line which is true and perpendicular to the trunk axis. Thereafter, drill 56 is utilized to drive bit 55 into the score-cut tree trunk, and with guide 40 being employed, an opening or bore such as at 57 is formed within the trunk. Thereafter, lag screw 26 is placed in contact with the opening of bore 57, and by rotation of the stand 10 in its assembled position, lag screw 26 is caused to enter bore 57 to an appropriate depth, particularly to a depth wherein the outer circumference of trunk 12 engages or bears on stabilizing levelers 29—29. Thereafter, the tree and stand assembly is placed on the floor or other supporting surface, and pads 19 are rotated until a desired level is achieved.

In order to permit decorative materials to be placed about tree with the stand in place, an annular ring disc generally designated 60 such as illustrated in FIG. 5 is placed on the edges of stop gussets 61—61 in order to prevent decorative materials such as decorative cloth and the like from falling into the confines of the water retaining tank 15. Annular ring disc 60 is most conveniently placed upon the trunk of tree 13 prior to attachment of stand 10 thereto. Alternatively, a radial slit may be formed in annular ring disc 60 to permit attachment after attachment of stand 10 to tree 13.

It will be appreciated, of course, that the examples given herein are for purposes of illustration only, and that those skilled in the art may depart from the teachings and examples herein without departing from the spirit and scope of the present invention.

What is claimed is:

1. In a decorative tree stand having means for adjustably positioning and retaining the butt end of a tree trunk and reservoir means for receiving a supply of water for delivery to said butt end, said tree stand comprising, in combination:

(a) reservoir means comprising a generally cylindrical water retaining tank with a closed bottom, a generally upstanding side wall, and an open top; said closed bottom having means for rigidly and attachably receiving a tree mounting stabilizer base plate thereon, and arcuately spaced radially disposed adjustably positionable tree stand leveling pads mounted along the underside of said closed bottom;

(b) a tree mounting stabilizer base plate with tank bottom engaging attachment means thereon, lag screw means fast upon and rotatable with said stabilizer base plate and projecting upwardly therefrom for engagement with and attachment to said butt end;

(c) a plurality of arcuately spaced radially extending stabilizing levelers secured to said stabilizer base plate and positioned radially outwardly from said lag screw means and extending upwardly from said stabilizer base plate;

(d) said stabilizing levelers being tapered inwardly to engage the tree along the butt end thereof while being held by and secured to said lag screw means and to provide arcuately spaced contact support between said levelers and said tree primarily on the surface of said butt end along and adjacent the circumference thereof; and (e) said leveling pads being operatively arranged to position said tree stand for retention of said tree in a substantially upright disposition.

2. The decorative tree stand combination as defined in claim 1 being particularly characterized in that said stabilizing levelers comprise flanged butt end contacting surfaces.

3. The decorative tree stand combination as defined in claim 1 wherein three equally arcuately spaced stabilizing levelers are provided.

4. The decorative tree stand combination as defined in claim 1 being particularly characterized in that reinforcing ribs are coupled to said retaining tank along the underside thereof.

* * * * *